US005373311A

United States Patent [19]

Strait et al.

[11] Patent Number: 5,373,311

[45] Date of Patent: Dec. 13, 1994

[54] IMAGE DISPLAY APPARATUS AND METHOD

[75] Inventors: John P. Strait, Pittsburgh, Pa.; Clive L. Mayne, North Wembley; Lindsay W. MacDonald, Bedfordshire, both of England; Brian S. Rosen, Mars, Pa.; Richard E. Huber, Harmony, Pa.; David M. Kern, Springdale, Pa.

[73] Assignee: Crosfield Electronics Limited, Stevenage, England

[21] Appl. No.: 999,725

[22] Filed: Dec. 31, 1992

Related U.S. Application Data

[63] Continuation of Ser. No. 657,796, Feb. 20, 1991, abandoned.

[30] Foreign Application Priority Data

Feb. 21, 1990 [GB] United Kingdom ..... 9003922

[51] Int. Cl.[5] ..... G09G 1/28

[52] U.S. Cl. ..... 345/200; 345/121; 345/127

[58] Field of Search ..... 340/703, 723, 724, 728, 340/747, 739, 750; 345/121, 123, 127, 130, 138, 200

[56] References Cited

U.S. PATENT DOCUMENTS

| | | | |
|---|---|---|---|
| 4,725,892 | 2/1988 | Suzuki et al. | 345/127 |
| 4,734,690 | 3/1988 | Waller | 340/723 |
| 4,757,311 | 7/1988 | Nakamura et al. | 345/121 |
| 4,855,935 | 8/1989 | Lien et al. | 340/739 |
| 4,870,406 | 9/1989 | Gupta | 340/703 |
| 4,878,182 | 10/1989 | Aranda et al. | 340/728 |
| 4,988,984 | 1/1991 | Gonzalez-Lopez | 340/728 |
| 5,021,772 | 6/1991 | King et al. | 340/724 |
| 5,125,043 | 6/1992 | Karlsson | 345/130 |
| 5,167,018 | 11/1992 | Ueda | 340/750 |
| 5,202,670 | 4/1993 | Oha | 340/728 |

FOREIGN PATENT DOCUMENTS

| | | |
|---|---|---|
| 149788 | 7/1985 | European Pat. Off. . |
| 328356 | 8/1989 | European Pat. Off. . |

OTHER PUBLICATIONS

Pp. 432–437, "Raster Algorithms and Software", date unknown.

*Primary Examiner*—Alvin E. Oberley
*Assistant Examiner*—Steven J. Saras
*Attorney, Agent, or Firm*—Sughrue, Mion, Zinn, Macpeak & Seas

[57] ABSTRACT

Image display apparatus comprises a display monitor; an image frame buffer for storing data defining the color content of pixels of an image; and a control system for selecting from the frame buffer for each pixel displayed on the monitor the appropriate pixel data from the frame buffer. The relationship between the monitor pixels and the frame buffer pixels is defined by a preselected composite linear function, wherein the control system determines the frame buffer pixels corresponding to the monitor pixels by applying the preselected composite linear function in a stepwise manner.

4 Claims, 3 Drawing Sheets

IMAGE DISPLAY APPARATUS AND METHOD

This is a continuation of application Ser. No. 07/657,796 filed Feb. 20, 1991 now abandoned.

FIELD OF THE INVENTION

The invention relates to image display apparatus and a method for controlling such apparatus which comprises a display monitor; an image frame buffer for storing data defining the colour content of pixels of an image; and control means for selecting from the frame buffer for each pixel displayed on the monitor the appropriate pixel data from the frame buffer. Such apparatus is hereinafter referred to as of the kind described.

DESCRIPTION OF THE PRIOR ART

Apparatus of the kind described is used in a wide variety of fields including image display systems in which an image is to be modified or retouched by an operator. To aid the retouch or modification operation, such apparatus typically includes a number of functions which enable an image held in the form of digital, colour data in a frame buffer to be shown in various ways on the monitor. For example, the image can be amplified, scrolled, zoomed and panned.

The first transformation, Amplification, provides two methods for presenting an image with reduced resolution. The first method produces a full-size video display by magnifying (scaling) a reduced-size image. This allows several low-resolution images to coexist in the frame buffer. The second method subsamples a full-size image in the frame buffer to produce a reduced-resolution image. Subsampling is used when a complex computation such as rotation is being performed on the image in the frame buffer. If the computation is too lengthy to complete in a single frame refresh period, the display response may be too slow to sustain a satisfactory degree of interaction by the operator. In this case sub-sampling can improve the speed of interaction by reducing the computational load. If the image is subsampled at 2:1 (in both X and Y), only one quarter of the pixels need be computed to provide an acceptable display. Once the computation is completed on the remaining pixels the image is shown in full resolution. The procedure is described in U.S. Pat. No. 4,829,370.

The second transformation called Scrolling, allows translation of the image left or right and up or down by an integral number of pixels. This allows positioned of the image on the display screen. When the image is also Amplified, Scrolling positions the image as though it were displayed at full resolution.

The third transformation, Zooming, scales the image by a factor that must be greater than or equal to one. This factor need not be an integer. Zooming differs from Amplification primarily in the way it is used rather than the way it is implemented. Amplification is used to control the way the data in the frame buffer is interpreted by the display hardware whereas Zooming is used to allow the operator to examine portions of the picture at a higher magnification.

The final transformation, Panning, translates the image left or right and up or down by an integral number of displayed pixels (which may be a fractional number of input pixels). Panning differs from scrolling primarily in the way it is used rather than the way it is implemented. The Scroll value controls the alignment of the image in the frame buffer whereas Panning controls the alignment of the picture on the display. If the image is Zoomed, the units of Panning differ from the units of Scrolling.

In order to achieve one or more of the four transformations described above, the control means has to determine for each monitor pixel which pixel or pixels in the frame buffer must be used. In the past, it would require a complex logic implementation to achieve this functionality. Separate logic is needed for each function of zoom, scroll, amplify, such that the implementation would become costly and impractical.

SUMMARY OF THE INVENTION

In accordance with one aspect of the present invention, in image display apparatus of the kind described, the relationship between the monitor pixels and the frame buffer pixels is defined by a preselected composite linear function, wherein the control means determines the frame buffer pixels corresponding to the monitor pixels by applying the preselected composite linear function in a stepwise manner.

In accordance with a second aspect of the present invention, a method of operating image display apparatus of the kind described comprises selecting a composite linear function defining the relationship between the monitor pixels and the frame buffer pixels; and causing the control means to determine the frame buffer pixels corresponding to the monitor pixels by applying the preselected composite linear function in a stepwise manner.

We have recognised for the first time that the composite functions which are normally used to transform an image stored in the frame buffer prior to display can all be reduced to a linear form. Having recognised this, it is then possible to implement the method of providing a concordance between monitor pixels and frame buffer pixels by using certain known line drawing algorithms which have previously been proposed for enabling stepwise approximations to straight lines to be generated on a monitor display. This in turn has allowed us to implement the control means in a convenient hardware form rather than the previous software which has considerably decreased processing time and thus improved interactively.

The method thus provides a single simplified logic implementation which allows each of the functions to be provided or any combination of them. This logic implementation however requires a series of look-up tables to be loaded to define the relationship between monitor pixels and frame buffer pixels. The computation of the contents of the look-up tables must be carried out within a single frame refresh period to sustain interactive response.

In the preferred example, the control means is adapted to implement the selected composite linear function in accordance with Bresenham's algorithm. This will be described in more detail below but essentially involves incrementing the addresses of one set of the pixels (typically the monitor pixels) and then determining whether a change in the addresses of the corresponding set of pixels (typically the frame buffer pixels) should be implemented and, if so, what that change should be.

The preselected composite linear function may define one or a combination of image amplification, image scroll, image pan and image zoom.

Typically, if the Bresenham algorithm is implemented and a combination of all four transformations is required then the relationship between the address of each frame buffer pixel ($X_{FB}$) and the address of the corresponding monitor or video display pixel ($X_{VD}$) is defined as:

$$X_{FB}=SS^{*}\ \mathrm{Trunc}\ (B^{*}X_{VD}/(A^{*}SS^{*}M)+(B^{*}P+A^{*}S)/(A^{*}SS^{*}M))-+SA \quad (1)$$

where

P is the monitor pixel address offset for pan

A, B are integers defining a zoom ratio A:B (A<=B)

S is the frame buffer pixel address offset for scroll

SS is the amplification sub-sampling rate (ie. SS:1)

SA is offset in frame buffer of start of sub-sample (range 0<=SA<=SS−1)

M is magnification (ie. M:1).

A similar relationship can be defined and implemented between the frame buffer line address ($Y_{FB}$) and the monitor line address ($Y_{VD}$).

BRIEF DESCRIPTION OF THE DRAWINGS

An example of a method and apparatus according to the invention will now be described with reference to the accompanying drawings, in which.

DETAILED DESCRIPTION OF THE EMBODIMENT

Figure 1:
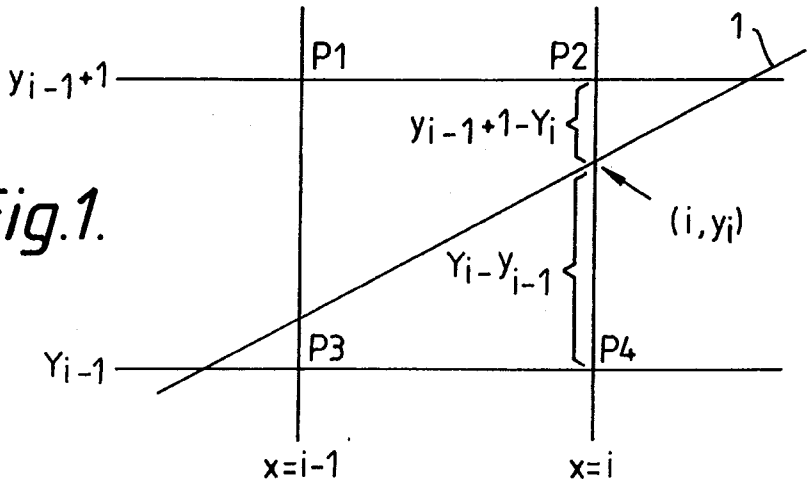
FIG. 1 illustrates graphically the principle of Bresenham's algorithm.

To understand the principle behind Bresenham's algorithm, reference should be made to FIG. 1. This illustrates part of a straight line 1 and its relation to four adjacent monitor display pixels P1-P4. It will be seen that none of the pixels P1-P4 exactly coincides with the position of the line 1 and it is necessary to select those pixels which are closest to the line.

Suppose that at x=i−1 the point (i−1, $y_{i-1}$) i.e. P3 best represents the true position of the line. Then, at x=i, the pixel position chosen should be that which is closest to the true line. From FIG. 1, it can be seen that the rule for selecting the pixel position at x=i should be:

$$\text{if } (y_{i-1}+1-Y_i)<(Y_i-y_{i-1}) \text{ then choose } P_2(i,y_{i-1}+1) \text{ else choose } P_4\ (i,y_{i-1}) \quad (2)$$

where $Y_1$ is the true height of the line at x=i. This rule can be simplified as follows:

$$\text{choose } (i,y_{i-1}+1) \text{ if } 2y_{i-1}+1-2Y_i<0$$

That is, if:

$$c_{i-1}<0 \quad (3)$$

where $c_{i-1}=2y_{i-1}+1-2(dy/dx)i$.

Since $dx>0$, this rule is equivalent to:

$$\text{choose } (i,y_{i-1}+1) \text{ if } e_{i-1}<0 \quad (4)$$

where $e_{i-1}=2dxy_i+dx-2dyi$, from which, $e_i=2dxy_i+dx-2dy(i+1)$ so that by subtraction:

$$e_i=e_{i-1}+2dx(y_i-y_{i-1})-2dy \quad (5)$$

However, from Equation (4)

if $e_{i-1}<0$, then $y_i-y_{i-1}=1$ else $y_i-y_{i-1}=0$

Therefore, Equation (5) can now be expressed as follows. Suppose (i,$y_i$) is the best pixel position at x=i, then at x=i+1:

$$\text{choose } (i+1,y_i+1) \text{ if } e_i<0$$
$$\text{where } e_i=e_{i-1}+2(dx-dy) \text{ if } e_{i-1}<0$$
$$e_{i-1}-2dy \text{ otherwise}$$
$$\text{else choose } (i+1,y_i)\ (i=1,2\ldots,dx).$$

The Bresenham algorithm is well known in the field of computer graphics, where it has been widely used for drawing lines on bit-mapped raster displays. See "Fundamentals of Interactive Computer Graphics", J. D. Foley & A. Van Dam (Addison-Wesley 1983) pp. 433-6.

The novel application of this algorithm to image display apparatus will be described below.

Figure 2:
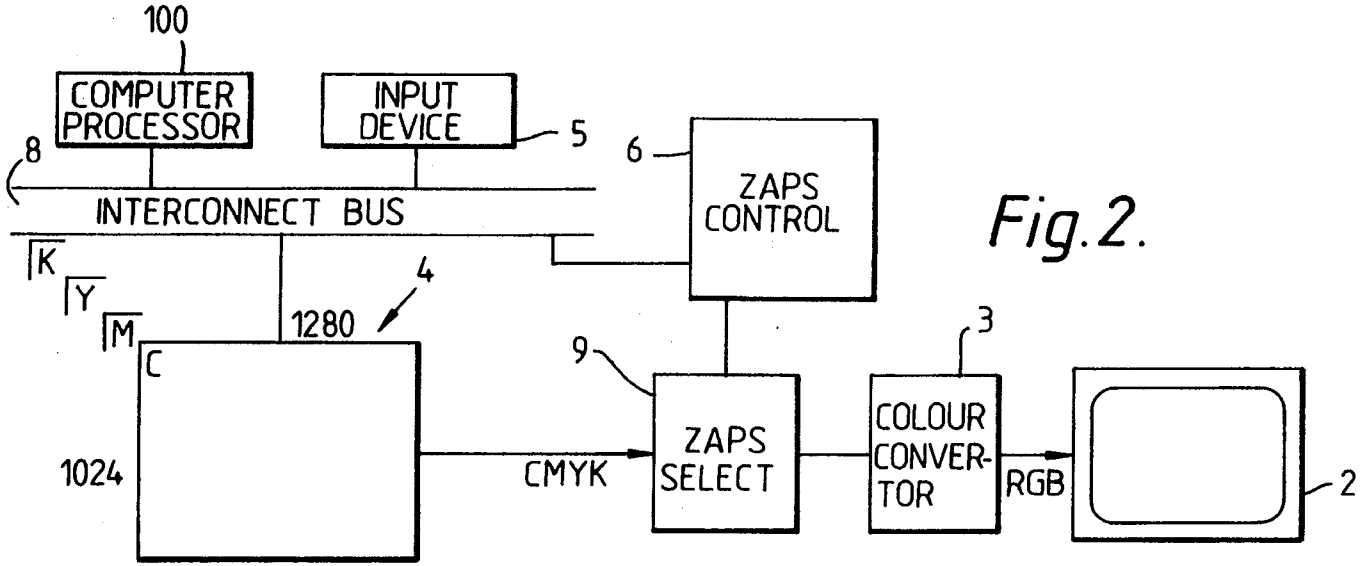
FIG. 2 is a block diagram of image display apparatus.

FIG. 2 illustrates in block diagram form, an example of image display apparatus which comprises a video monitor 2 coupled to a conventional colour converter 3 which receives pixel data defining printing ink colour components: cyan (C), magenta (M), yellow (Y) and black (K) and converts these to red (R), green (G) and blue (B) colour components which activate the respective phosphors of the monitor display. The CMYK components are held in a frame buffer 4 with the frame buffer typically comprising four arrays of pixels, each array having dimensions 1280×1024 pixels. Each array corresponds to one of the colour components and each colour component is defined by eight bit data. The data has been loaded into the frame buffer 4 in a conventional manner from an image scanner or a storage device (not shown) via the interconnect bus 8 and under the control of a processor 100.

In order to select the desired portion of the image stored in the frame buffer 4 an operator-actuated input device 5 is provided (such as a mouse or digitising table or the like) which inputs coordinate values to the suitably programmed computer processor 100 via an interconnect bus 8. The processor 100 in turn sends control volumes to a ZAPS (Zoom, Amplify, Pan, Scroll) control device 6 (to be described in more detail below). The ZAPS control device 6 is connected to a ZAPS select device 9 which receives pixel data from the frame buffer 4 and supplies selected video data to the colour converter 3.

As has been explained above, the operator can arrange for different forms of the image stored in the frame buffer 4 to be displayed. For example, he can cause the image to be scrolled (S), panned (P), amplified (A), and zoomed (Z).

The ZAPS control device 6, determines from the commands it receives from the input device (for example scroll and amplify) the addresses of the frame buffer pixel containing the data to be used to control the monitor display. This is advantageously performed in hardware by making use of Bresenham's algorithm as defined above.

For simplicity, we will describe the algorithm as though it were only applied along the X-axis although in practice the algorithm can be applied to both the X and Y axes independently.

In implementation of the ZAPS algorithm, we invert the image transformations. Rather than transform the frame buffer image as it is being displayed, we consider the inverse transformation. For a given position on the monitor screen, we wish to compute the corresponding position in the frame buffer. From this point of view, the four transformations are applied in reverse order.

First, the screen coordinate is Panned, then Zoomed, Scrolled and finally Amplified to derive the frame buffer address. We will present the ZAPS algorithm in this order.

Panning of the image provides the ability to move the image on the display screen left or right by an integral number of displayed pixels. If the image is also Zoomed or Amplified, each displayed pixel may be a fractional part of a pixel in the frame buffer. In the absence of Zooming, Scrolling and Amplifying, a simple function relates the address on the video display, $X_{PVD}$, to the address in the frame buffer, $X_{PFB}$:

$$X_{PFB} = F_P(X_{PVD}, P) = X_{PVD} + P$$

Pan by $P$ displayed pixels

Zooming the image magnifies it by a ratio of two integers A:B. Again, a simple function describes Zoom in the absence of other transformations:

$$X_{ZFB} = F_Z(X_{ZVD}, A,B) = \text{Trunc}(B*X_{ZVD}/A)$$

Zoom by the ratio $A$:$B$

Scrolling is Panning that is applied to un-Zoomed pixels. This has the effect of moving the image left or right by an integral number of frame buffer pixels:

$$X_{SFB} = F_S(X_{SVD}, S) = X_{SVD} + S$$

Scroll by $S$ frame buffer pixels

Amplification of the image serves two distinct purposes. First, a number of smaller images may be held in the frame buffer and magnified by pixel replication when displayed. This magnification is by an integral amount. That is, the pixels in the frame buffer may be replicated horizontally and vertically a certain number of times. We will use the integer M to represent the magnification factor.

The second function of Amplification is to display images in reduced resolution. That is, pixels may be selected from the frame buffer at regular intervals and replicated by the same factor so that the image size is unchanged. This sub-sampling rate must also be an integral amount, denoted SS. We must also specify the alignment, SA, of the sub-sampling to the frame buffer. SA is restricted to the range 0 to SS−1.

Sub-sampling and magnification may be combined to provide a magnified, reduced-resolution image. The following function relates the position in the frame buffer, $X_{AFB}$, to the position on the video display, $X_{AVD}$:

$$X_{AFB} = FA(X_{AVD}, SS, SA, M) = SS * (X_{AVD}\text{div } (SS*M) + SA)$$

Sub-sample by $SS$:1.
Begin sub-sample at $SA$.
Magnify by $M$:1.

Finally, we need to compose these functions into the ZAPS function:

$$\begin{aligned} X_{FB} &= F_{ZAPS}(X_{VD}, SS, SA, M, S, A, B, P) \\ &= FA(FS(FZ(FP(X_{VD}, P), A,B), S), SS, SA, M) \\ &= SS * (FS(FZ(FP(X_{VD}, P), A, B), S) \text{ div } (SS*M)) + SA \\ &= SS * (FZ(FP(X_{VD}, P), A, B) + S) \text{ div } (SS*M)) + SA \\ &= SS * ((\text{trunc}(B*FP(X_{VD}, P)/A) + S) \text{ div } (SS*M)) + SA \\ &= SS * ((\text{trunc}(B*(X_{VD} + P)/A) + S) \text{ div } (SS*M) + SA \end{aligned}$$

The mathematical function trunc returns the integer part of its argument, i.e. it truncates the fractional part.

e.g. trunc (5.3)=5

The mathematical function div returns the quotient of a division as an integer, discarding the remainder e.g. 9 div 4=2

The mathematical function mod returns the remainder of division by an integer e.g. 9 mod 4=1

It is always true that (trunc(u) div v)+w=trunc((u/v)+w) if v and w are integers.

Thus $F_{ZAPS}$ can be rewritten:

$$\begin{aligned} X_{FB} &= F_{ZAPS}(X_{VD}, SS, SA, M, S, A, B, P) \\ &= SS*\text{trunc}((B*(X_{VD} + P)/A + S)/(SS*M)) + SA \\ &= SS*\text{trunc } (B*X_{VD}/(A*SS*M) + (B*P + \\ &\quad A*S)/(A*SS*M)) + SA \end{aligned}$$

Since the portion inside the Trunc has the linear form a*X/b+c/b

We see that this can be implemented with Bresenham's algorithm. The following shows the implementation of the ZAPS algorithm using Bresenham's algorithm. If we restrict the panning and scrolling parameters to be integers (rather than fractions), we can use truncated arithmetic thereby reducing the hardware data path widths by one bit. The algorithm can now be stated as follows:

```
var   XVD: integer;      [always an integer]
      XFB: integer;      [integer portion]
      FFB: integer;      [fractional portion, scaled]
      XS: integer;       [X step]
      XSpl: integer;     [X step + 1]
      FS: integer;       [F step]
      FSml: integer;     [F step − 1]
    begin
      XS := B div (A*SS*M) * SS;
      XSpl := XS + SS;
      FS := B mod (A*SS*M);
      FSml := FS − A*SS*M;
      XFB := ((B*P + A*S) div (A*SS*M)) *SS + SA;
      FFB := ((B*P + A*S) mod (A*SS*M)) −
A*SS*M+B mod (A*SS*M);
      XVD := 0;
      for i := 0 to N do
        begin Emit (i, XVD, XFB);
          XVD := XVD + 1;
          if FFB >= 0 then
            begin XFB := XFB + XSpl;
              FFB := FFB + FSml
            end
          else
            begin XFB:= XFB + XS;
              FFB:= FFB + FS
            end
      end
    end
```

Thus we have shown that the ZAPS algorithm, which at first appears to require a relatively complex computation, can be efficiently implemented using Bresenham's algorithm.

When the frame buffer is organised with a single pixel in each word, the ZAPS algorithm simply produces an address to the frame buffer for each displayed pixel. In order to provide memory bandwidth sufficient for contemporary video displays, however, most frame buffers are organised in a way that delivers many adjacent pixels on each memory reference. Such frame buffers, particularly those that are implemented with Video RAM devices, usually require that data be read sequentially through the video port.

We assume that each memory reference delivers K adjacent pixels of the frame buffer, that the address of the first pixel in the K-pixel word is zero mod K and that the frame buffer is read sequentially. The operations defined on the frame buffer are 1) initialise the frame buffer address and 2) read the next K-pixel word from the frame buffer.

In order to generalise the ZAPS algorithm for K-pixel words, we require the Zoom ratio to be greater than or equal to one. Ratios that are less than one are disallowed because they would require fetching frame buffer data faster than the display rate, which is generally not possible.

Figure 3:
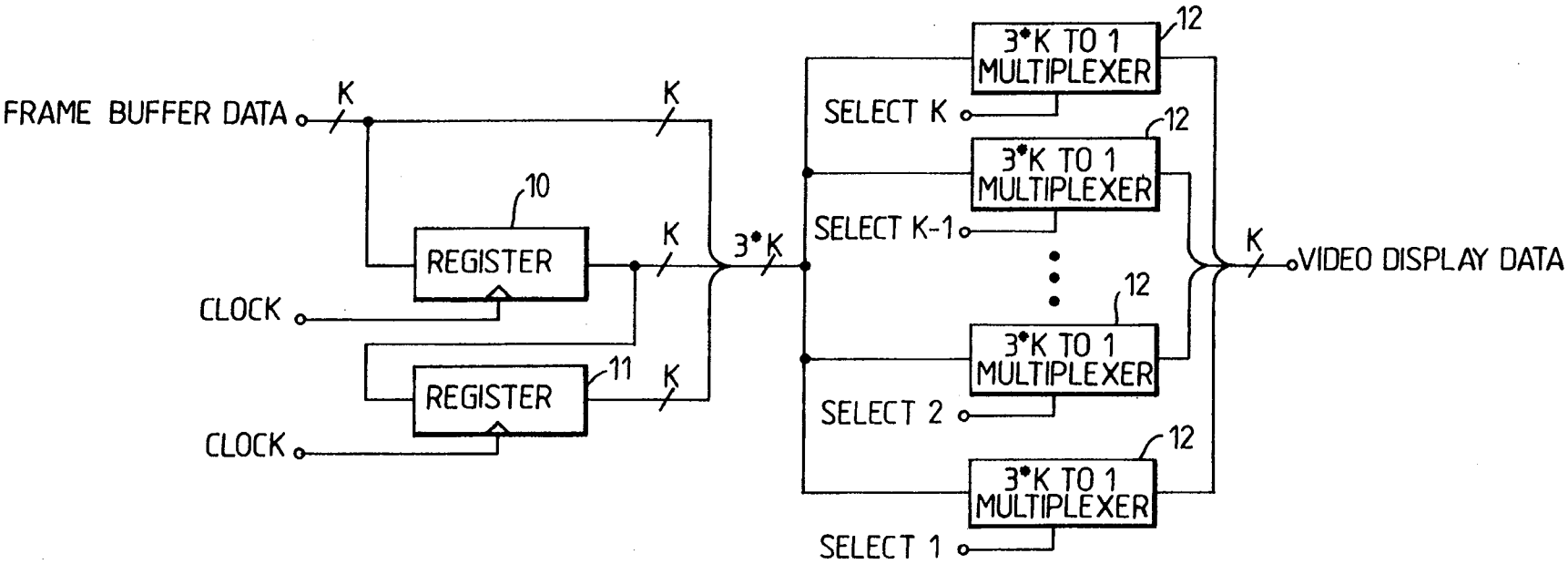
FIG. 3 illustrates in block diagram form part of the selection hardware; and, FIG. 4 illustrates in block diagram form the remainder of the selection hardware.

The ZAPS select hardware 9 is placed between the frame buffer 4 and the video output pipeline. It receives words containing K adjacent pixels from the frame buffer. It passes K-pixel words to the video pipeline. The ZAPS select hardware 9 under the control of the ZAPS control hardware 6 selects and arranges pixels so that the properly amplified, scrolled, zoomed and panned image is presented to the display monitor. Two previous words must be saved by the ZAPS select hardware 9 as candidates for this selection process. In the absence of amplification only one needs to be saved. FIG. 3 illustrates the ZAPS select hardware 9 in more detail. Data from the frame buffer 4 is fed in parallel to a pair of registers 10, 11 whose outputs, along with the original data are fed to a set of K multiplexers 12. Each multiplexer can be separately selected by the ZAPS control device 6 (to be described below) so as to output the correct data to the video pipeline and hence to the colour converter 3.

In order to present the correct data to the video pipeline, the ZAPS hardware operates on two levels. First, it determines when to read the next word from the frame buffer. Second, it selects K pixels from the current and previous few words to construct the output word. For example, if the unzoomed, unamplified image is scrolled, K adjacent pixels are chosen from two adjacent words. If the image is amplified with a 2:1 sub-sample, every other pixel is chosen twice.

The selection of pixels is implemented by executing K steps of Bresenham's algorithm. Rather than computing $X_{FB}$ as a single variable, we split its value into a word address, $W_{FB}$, and a select address $S_{FB}$ for the multiplexer shown in FIG. 3, such that $$X_{FB}=K * W_{FB}+S_{FB}.$$

We allow the value of $W_{FB}$ to change only every K Bresenham steps. Every K steps we examine the value of $S_{FB}$. If it exceeds K, we subtract K and increment $W_{FB}$, that is, we read the next word from the frame buffer.

In the absence of amplification, $S_{FB}$ can never be increased by more than K in K Bresenham steps since the zoom is never less than one. Thus the hardware never needs more than the current word and the previous word from the frame buffer. If amplification is allowed, $S_{FB}$ can be increased by up to 2* (K−1) in K Bresenham steps. This occurs when sub-sampling by K−1. In this case, $S_{FB}$ will sometimes reach or exceed $2*W_{FB}$ (but never $3*W_{FB}$) requiring the current word and two previous words.

Figure 4:
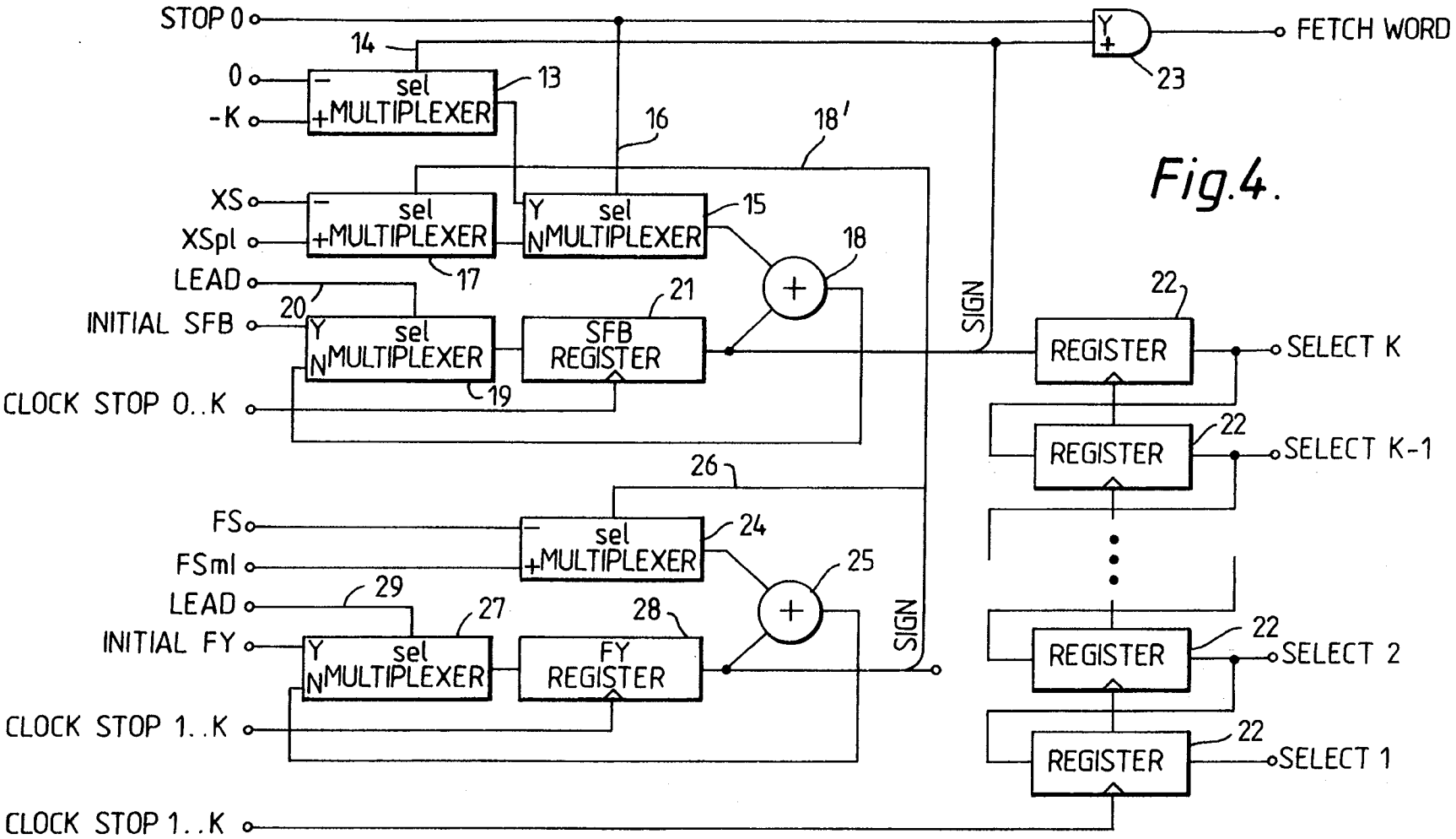

The ZAPS control hardware 6 is shown in FIG. 4. The circuit comprises a multiplexer 13 which responds to the sign of an input on a line 14 to pass a value 0 (−ve) or −K (+ve) to a multiplexer 15 which in turn passes to its output the value from the multiplexer 13 if a logic input 16 is true (Y) or the output from a multiplexer 17 if the logic signal 16 is false (N). The multiplexer 17 receives a signal XS and a signal XSp1, the first signal being sent to the multiplexer 15 if a select signal 18 is negative and the second being fed to the output if the select signal 18' is positive. The output from the multiplexer 15 is fed to an adder 18.

A further multiplexer 19 receives the output from the adder 18 and also an initial SFB signal (as defined above) and responds to a select signal 20 to pass either the initial SFB signal (if the signal 20 is true (Y)) or otherwise the signal from the adder 18 to an SFB register 21. The output from the register 21 is fed to the adder 18 and also to a first register 22 while a signal representing the sign of the output from the register 21 is fed to the line 14 and also to one input of an AND circuit 23. The other input of the AND circuit 23 receives a step "0" signal.

A multiplexer 24 receives signals representing FS and FSm1 and passes the first signal to an adder 25 if an input signal on a line 26 represents a negative value and passes the second signal to the adder 25 if the input signal on the line 26 represents a positive value. A multiplexer 27 receives on one input the output from the adder 25 and on its other input an initial FY signal. The first is passed through to a register 28 if the signal on a line 29 is a logic false (N) and the second is passed to the register 28 if the signal on the line 29 is a logic true (Y). The output from the register 28 is fed to the adder 25 while the sign of the output is fed to the line 18. As shown in FIG. 4, clocks are provided for controlling operation of the register 21, the register 28, and the registers 22. The output from the AND gate 23 causes a new word to be fetched from the frame buffer while the outputs from the registers 22 are fed as inputs to the multiplexers 12 of FIG. 3.

The algorithm implemented by the circuit shown in FIG. 4 is defined below and it will be noted that the value of $S_{FB}$ is offset by subtracting K in order that only its sign bit needs to be examined to determine whether to fetch a new word from the frame buffer.

```
var   XVD: integer;      [always an integer]
      WFB: integer;      [word address in frame buffer]
      SFB: integer;      [mux select]
      FFB: integer;      [fractional portion, scaled]
      XS: integer;       [X step]
      XSpl: integer;     [X step + 1]
      FS: integer;       [F step]
      FSml: integer;     [F step − 1]
begin
      XS:= B div (A*SS*M) *SS;
      XSpl:= XS + SS;
      FS:= B mod (A*SS*M);
      FSml:= FS − A*SS*M;
      WFB:= (((B*P+A*S) div (A*SS*M))*SS + SA) div K;
      SFB:= (((B*P+A*S) div (A*SS*M))*SS+SA)
      mod K−K;
      FFB:= ((B*P+A*S) mod (A*SS*M) − A*SS*M +
        B mod(A*SS*M);
      Fetch (WFB);          [initialise the leftovers]
      WFB:= WFB + 1;
      Fetch (WFB);          [initialise the leftovers]
      WFB:= WFB + 1;
```

-continued

```
Fetch (W_FB);                [initialise the leftovers]
W_FB:= W_FB + 1;
for i:= 0 to N do
  begin
   if i mod k = 0 then
     if S_FB>=0 then
       begin Fetch (W_FB);
         W_FB:= W_FB + 1;
         S_FB:=S_FB - K
       end;
  Emit(S_FB);
  if F_FB>=0 then
   begin S_FB:= S_FB + XSpl;
     F_FB:= F_FB + FSml
   end
  else
   begin S_FB:= S_FB + XS;
     F_FB:= F_FB + FS
   end
 end
end
```

FIG. 4 shows the complete ZAPS control hardware incorporating support for multi-pixel words. This circuit executes groups of K+1 steps. Step 0 examines $S_{FB}$ to determine whether it is necessary to fetch a word from the frame buffer. If $S_{FB}$ is non-negative, a word is fetched and $S_{FB}$ is decreased by K. During step 0 the value of FY is not changed. Steps 1 through K advance $S_{FB}$ and FY to compute the K values of the multiplexer selects.

We claim:

1. Image display apparatus comprising a display monitor; an image frame buffer for storing data defining the colour content of pixels of an image; and a control means for selecting from the frame buffer for each pixel displayed on the display monitor the appropriate pixel data from the frame buffer, characterised in that the relationship between the monitor pixels and the frame buffer pixels is defined by a preselected composite linear function comprising at least two linear functions selected from the group consisting of zooming, amplification, panning, and scrolling, wherein during scanning of an image displayed on the display monitor the control means determines the frame buffer pixels corresponding to the monitor pixels by applying the preselected composite linear function on a pixel-by-pixel basis downstream of the frame buffer and outputting said determined frame buffer pixels directly to the display;

wherein the control means is adapted to implement the selected composite linear function in accordance with Bresenham's algorithm; and wherein the relationship between the address of each frame buffer pixel and the address of the corresponding monitor or video display pixel is defined as:

$$X_{FB}=SS * \text{Trunc}\,(B*X_{VD}/A*SS*M)+(B*P+A*S)/(A*SS*M))+SA \qquad (1)$$

where

P is the monitor pixel address offset for pan;

A, B are integers defining a zoom ratio A:B ($A \leqq B$);

S is the frame buffer pixel address offset for scroll;

SS is the amplification sub-sampling rate (i.e. SS:1);

SA is offset in frame buffer of start of sub-sample (range $0 \leqq SA \leqq SS-1$); and M is magnification (i.e. M:1).

2. Apparatus according to claim 1, wherein the composite linear function comprises zooming, amplification, panning, and scrolling.

3. A method of operating image display apparatus comprising a display monitor; an image frame buffer for storing data defining the colour content of pixels of an image; and a control means for selecting from the frame buffer for each pixel displayed on the display monitor the appropriate pixel data from the frame buffer, the method comprising selecting a composite linear function comprising at least two linear functions selected from the group consisting of zooming, amplification, panning, and scrolling, said composite linear function defining the relationship between the monitor pixels and the frame buffer pixels; and during scanning of the monitor display causing the control means to determine the frame buffer pixels corresponding to the monitor pixels by applying the preselected composite linear function on a pixel-by-pixel basis downstream of the frame buffer and outputting said determined frame buffer pixels directly to the display;

wherein the control means is adapted to implement the selected composite linear function in accordance with Bresenham's algorithm; and wherein the relationship between the address of each frame buffer pixel and the address of the corresponding monitor or video display pixel is defined as:

$$X_{FB}=SS * \text{Trunc}\,(B*X_{VD}/A*SS*M)+(B*P+A*S)/(A*SS*M))+SA \qquad (1)$$

where

P is the monitor pixel address offset for pan;

A, B are integers defining a zoom ratio A:B ($A \geqq B$);

S is the frame buffer pixel address offset for scroll;

SS is the amplification sub-sampling rate (i.e. SS:1);

SA is offset in frame buffer of start of sub-sample (range $0 \leqq SA \leqq SS-1$); and M is magnification (i.e. M:1).

4. A method according to claim 3, wherein the composite linear function comprises zooming, amplification, panning, and scrolling.

* * * * *